US005509396A

United States Patent [19]

Tamaki

[11] Patent Number: 5,509,396

[45] Date of Patent: Apr. 23, 1996

[54] THROTTLE VALVE ACTUATING APPARATUS FOR USE IN INTERNAL COMBUSTION ENGINE

[75] Inventor: Shigeo Tamaki, Katsuta, Japan

[73] Assignee: Hitachi, Ltd. and Hitachi Automotive Engineering Co., Ltd., Japan

[21] Appl. No.: 226,468

[22] Filed: Apr. 12, 1994

[30] Foreign Application Priority Data

Apr. 12, 1993 [JP] Japan ..... 5-084640

[51] Int. Cl.[6] ..... F02D 9/02

[52] U.S. Cl. ..... 123/400; 251/337

[58] Field of Search ..... 123/361, 399, 123/400, 401, 403; 251/305, 337

[56] References Cited

U.S. PATENT DOCUMENTS 5,168,852 12/1992 Moriguchi et al. ..... 123/400

5,269,273 12/1993 Yasuda et al. ..... 123/400 X

FOREIGN PATENT DOCUMENTS 61-54938 11/1986 Japan .

64-87838 3/1989 Japan .

*Primary Examiner*—Tony M. Argenbright

*Attorney, Agent, or Firm*—Evenson, McKeown, Edwards & Lenahan

[57] ABSTRACT

In a throttle valve actuating apparatus, a return spring member is arranged between one side face of a throttle valve main body and an acceleration drum member. The return spring member includes two coil spring members. One collar member is arranged at a side of a throttle valve main body, and another collar member is arranged at an acceleration drum member. The two collar members are provided directly and independently surrounding a throttle valve shaft and are set for positioning the shaft. The movement of the return spring member is restrained by the two collar members. The return torque due to the return spring member can be transmitted smoothly.

15 Claims, 3 Drawing Sheets

THROTTLE VALVE ACTUATING APPARATUS FOR USE IN INTERNAL COMBUSTION ENGINE

BACKGROUND OF THE INVENTION

The present invention relates to a throttle valve actuating apparatus for use in an internal combustion engine such as a gasoline engine and, particularly to a throttle valve actuating apparatus suitable for use in an internal combustion engine of an automobile.

In an internal combustion engine for use in an automobile, in general a throttle valve of a throttle valve actuating apparatus is actuated through a wire member by operating an acceleration pedal. Further, when the acceleration pedal is released and the wire member has cut off, so as to close surely the throttle valve, a fail-safety function for the throttle valve is provided in the throttle valve actuating apparatus.

Namely, to provide the fail-safety function for the closing motion of the throttle valve, a return spring member is installed on the throttle valve shaft. In general, the throttle valve actuating apparatus is constituted by stepping on the acceleration pedal and the throttle valve is forced to turn toward an opening direction of the throttle valve against the elastic force through the return spring member.

Further, in the conventional throttle valve actuating apparatus techniques, in general a return spring member having at least two independent torsional coil spring members is provided on the throttle valve shaft and, consequently, even when one of the at least two independent torsional coil spring members of the return spring member is cut-off, the throttle valve is forced to an idle position and thus the throttle valve can be maintained surely.

However, when the return spring member having at least two independent torsional coil spring members is provided on the throttle valve shaft, it requires a superfluous space in the throttle valve actuating apparatus and further there is a possibility of the large space requirement for the throttle valve actuating apparatus.

Accordingly, even when the return spring member having at least two independent torsional coil spring members is provided on the throttle valve shaft, so as to constitute compactly the throttle valve actuating apparatus, the technique of the return spring member having two torsional coil spring members with different winding diameter is provided concentrically on the throttle valve shaft in the different lines is disclosed in, for example, Japanese patent publication No. 54,938/1986.

In this prior technique, two coil spring members of the return spring member are provided at an upper position and a lower position around the throttle valve shaft. The upper coil spring member has the large winding diameter and the lower coil spring member has the small winding diameter, respectively. Each of the upper and lower coil spring members of the return spring member is supported by a collar member having a collar portion (guide portion), respectively.

Further, a cylindrical shape sleeve member is provided between the upper and lower coil spring members, this sleeve member preventing the upper and lower coil spring members from contacting each other and also from interfering with each other.

Accordingly, in the above stated Japanese patent publication No. 54,938/1986, the throttle valve actuating apparatus has a complicated structure having many components and the return spring member comprises the concentrically arranged two coil spring members at the different radial directions of the throttle valve shaft.

Namely, in the technique shown in Japanese patent publication No. 54,938/1986, the return spring member is comprised of the upper coil spring member having the large diameter and the lower coil spring member having the small diameter, and on the throttle valve shaft the cylindrical shape sleeve member for determining a setting position of these coil spring members and other components for distinguishing the large diameter coil spring member and the small diameter coil spring member are provided specially.

In the above stated prior technique, however, there has not been taken fully into consideration the hysteresis phenomenon (reaction force) in the return torque which is given at the throttle valve shaft according to the return spring member, thereby causing a scattering phenomenon problem on the torque which appears to the throttle valve shaft.

As a result, when the throttle valve shaft is moved toward an opening direction of the throttle valve, the above distinguishing components contact the return spring member. In accordance with the contact between the above distinguishing components and the coil spring member, the hysteresis phenomenon is generated and the scattering phenomenon occurs on the coil spring members.

Further, the technique about a return spring member for a throttle valve actuating apparatus comprising two coil spring members is disclosed in, for example, Japanese patent laid-open No. 87,838/1989. In this latter prior art, the return spring member comprises a combination of two coil spring members having a same winding diameter and the same number of turns.

Namely, the return spring member disclosed in this prior art comprises a main coil spring member and an assist coil spring member for a fail-safety function. Each of one coil portion of the main coil spring member and the assist coil spring member are adjacently arranged. Namely, one coil portion of the assist coil spring member is inserted closely between two adjacent coil portions of the main coil spring member.

A sleeve member for retaining the return spring member is provided on a boss which is formed on bearing member portions of a throttle valve main body of the throttle valve shaft.

In the technique shown in Japanese patent laid-open No. 87,838/1989, the sleeve member for retaining the return spring member is provided on the boss formed on the throttle valve main body.

In general, the throttle valve main body is manufactured through an aluminum die casting method. For this reason between the sleeve member and the throttle valve main body a large friction resistance occurs. The return spring member is arranged on the sleeve member but is not arranged directly on the throttle valve shaft.

Further, when the throttle valve is opened gradually, the return spring member is twisted at the same time the diameter of the return spring member decreases. In particular, the coil diameter of the return spring member has the small outer diameter, and the change in the inner diameter of the return spring member increases furthermore.

Consequently, when the return spring member is turned toward the opening direction of the throttle valve, the return spring member may slip from the outer diameter portion. In this time, the force is transmitted to the sleeve member and, further this force is transmitted to the sleeve member and the throttle valve main body.

Further, when the return spring member is moved, the sleeve member is going to move, however, between the throttle valve main body and the sleeve member since the friction resistance is high via the large friction force acting thereon. Due to this large friction force the hysteresis phenomenon generated and thereby the torque may scatter.

Further in this prior technique, in addition to the above stated hysteresis phenomenon due to the return spring member, a further hysteresis phenomenon is generated as follows.

Namely, when the throttle valve is turned toward the opening direction of the throttle valve the return spring member is wound, and the inner diameter of the return spring member decreases, while at the same time the inner diameter of the return spring member is squeezed remarkably at both end portions.

Besides, in this prior technique, since the sleeve member is provided and further the return spring member is provided on an outer periphery, as a result, when the throttle valve is turned toward the opening direction the return spring member makes a tight squeeze with the sleeve member.

Since the throttle valve is turned toward the opening direction the torsional force acts on two coil spring members of the return spring member in a reversed direction, and results in the smaller size of the coil diameter portion of the return spring member.

To sum up, in Japanese patent laid-open No. 87,838/1989, since the return spring member is provided on the throttle valve main body, the large friction force acts at the mounted contacting portion of the return spring member, thereby the return spring member can not move smoothly. At the non-smooth portion of the return spring member, the return spring member can not perform the original function, thereby a torque transmitting loss of the throttle valve shaft occurs.

In the above stated latter prior technique, however, there has not been fully into consideration the hysteresis phenomenon (reaction force) in the return torque which is given at the throttle valve shaft according to the return spring member. Thereby, it has a problem that the scattering phenomenon is caused on the torque which appears at the throttle valve shaft.

SUMMARY OF THE INVENTION

An object of the present invention is to provide a throttle valve actuating apparatus for use in an internal combustion engine wherein the opening and/or closing operation of a throttle valve shaft can be obtained with a smooth torque condition.

Another object of the present invention is to provide a throttle valve actuating apparatus for use in an internal combustion engine wherein no hysteresis phenomenon is generated due to a return spring member.

A further object of the present invention is to provide a throttle valve actuating apparatus for use in an internal combustion engine wherein a compact construction and a superior operation feel can be obtained.

A further object of the present invention is to provide a throttle valve actuating apparatus for use in an internal combustion engine wherein the components necessary for a throttle valve actuating mechanism having a return spring member can be reduced substantially and the transmitting loss of the return torque due to the return spring member can be decreased effectively.

A further object of the present invention is to provide a throttle valve actuating apparatus for use in an internal combustion engine wherein the occurrence of the touching feel to the driver can be restrained effectively.

In accordance with the present invention, a throttle valve actuating apparatus for use in an internal combustion engine comprises a throttle valve main body, bearing members provided on the throttle valve main body, a throttle valve shaft penetrating the throttle valve main body and supported through the bearing members, a throttle valve mounted fixedly on the throttle valve shaft in the throttle valve main body, an acceleration drum member provided on one end portion of the throttle valve shaft, and a return spring member arranged between one side face of the throttle valve main body and the acceleration drum member.

The return spring member comprises a first coil spring member and a second coil spring member, each of the first coil spring member and the second coil spring member having substantially the same inner diameter and substantially the same winding number of turns, and one coil portion of the second coil spring member arranged between two adjacent coil portions of the first coil spring member on substantially the same longitudinal line, the return spring member giving always the return torque to the throttle valve.

The distance between two adjacent coil portions of the first coil spring member of the return spring member is set to at least the sum of the wire diameter of the first coil spring member and the wire diameter of the second coil spring member, the distance between two adjacent coil portions of the second coil spring member of the return spring member is set to at least the sum of the wire diameter of the first coil spring member and the wire diameter of the second coil spring member.

A collar member comprises a first collar member and a second collar member, the first collar member arranged at an outside of the one side face of the throttle valve shaft and surrounding directly an outer peripheral portion of the throttle valve shaft, the second collar member arranged at an inside of the acceleration drum member and surrounding directly the outer peripheral portion of the throttle valve shaft, and the first collar member and the second collar member retaining the return spring member therebetween.

Thereby, the return spring member is turned with the throttle valve shaft according to the relative movement of the first collar member and the second collar member and the return spring member is positioned according to the first collar member and the second collar member.

Since the collar member is retained directly on the throttle valve shaft, incorporated with the return spring member comprised of two coil spring members in the same line, it can limit to the collar member as the contacting components by the return spring member, thereby it has no concern about the occurrence of the hysteresis phenomenon on the return spring member.

Namely, so as not to cause occurrence of the hysteresis phenomenon on the return spring member, the throttle valve actuating mechanism is made simply, and when the return spring member is twisted, it can prevent the return spring member from contacting to other components.

According to the present invention, since the components necessary for the throttle valve actuating mechanism having the return spring member can be reduced substantially and the transmitting loss of the return torque due to the return spring member can be decreased fully, the compact size throttle valve actuating apparatus and the superior operation feel can be achieved.

Further, according to the present invention, since the hysteresis phenomenon and the occurrence of the touching feel to the driver can be restrained effectively, the compact size throttle valve actuating apparatus and the superior operation feel can be obtained.

DETAILED DESCRIPTION OF THE INVENTION

Figure 1:
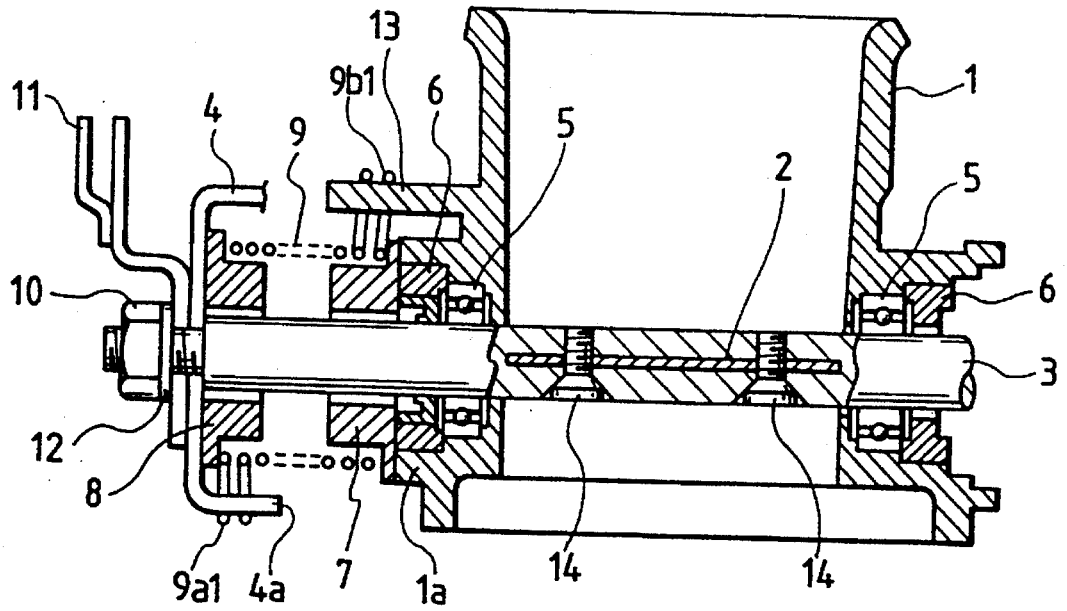
FIG. 1 is a longitudinal cross-sectional view showing one embodiment of a throttle valve actuating apparatus according to the present invention.

First of all, the concept about the embodiments according to the present invention will be explained as follows.

Concerning the solution for not generating the hysteresis phenomenon of the throttle valve shaft, so as not to generate the hysteresis phenomenon it is necessary to remove as much as possible the portion where the free movement of the return spring member is held back or checked.

So as to attain the above solution, the component provided on the throttle valve shaft is formed only with the collar member, the number of the components is reduced as much as possible, and further when the throttle valve is opened or closed the return spring member is made not contact to another component.

Further, when the return spring member contacts the components at the worst, the provision of the low friction resistance material for the collar member or the washer member reduces the friction resistance effectively.

Next, the return spring member according to the present invention comprises two coil spring members combined at the same longitudinal line or in the parallel state. So as to avoid the contact between coil portions of each of two coil spring members, each pitch of each of the coil spring members or each distance of two adjacent coil portions of each of the coil spring members is prepared to have the pitch or the distance which is at least two times the wire diameter of the coil spring member, for example, each of the coil spring members has the same wire diameter, respectively.

Namely, each pitch (distance between two adjacent coil portions of the respective coil spring member) of two coil spring members is formed with at least two times the wire diameter of the coil spring member.

In general, when one of the coil spring members has the large wire diameter ($l_r$) and another of the coil spring members has the small wire diameter ($l_s$), the pitch is the distance between two adjacent coil portions of the respective coil spring member. The above pitch of the coil spring member in the present invention is defined by at least the length of value ($l_r+l_s$).

Accordingly, by the provision of the above stated coil spring members, the return spring member has a space between one coil portion of one coil spring member and one coil portion of another coil spring member, this one coil portion of another coil spring member being adjacent to one coil portion of one coil spring member.

Thus, in the present invention, since the return spring member has the above stated space between two adjacent coil portions of one coil spring member and another coil spring member, it constitutes a space winding return spring member.

However, even when the space winding return spring member is prepared, the return spring member is installed into the throttle valve main body by twisting. In other words, since both end portions of the return spring member is fixed by twisting with the prescribed position or the prescribed distance, when the return spring member is installed into the throttle valve main body, it can not avoid to contact partially.

Accordingly, even the above stated contact condition occurs, so as to obtain the smooth move for the return spring member, the return spring member is coated with the fluorine system resin material, for example. In addition to the above, by preparing the throttle valve shaft coated by the chrome coating processing or the fluorine system synthetic coating processing and preparing the collar member by forming the nylon system synthetic resin material, thereby the move of the return spring member can be improved smoothly effectively.

Next, when the throttle valve is operated to the opening direction, the torsional torque due to the return spring member appears to the throttle valve shaft, in this time at the end portions of the return spring member the torsional torque generates toward the thrust direction of the throttle valve shaft and this torsional torque is added to the collar portion (guide portion) of the collar member.

Accordingly, when the distance across dimension of the guide portion of the collar member is insufficient, the coil portion at the end portion of the return spring member may stick out from the guide portion of the collar member and contact to the throttle valve main body, as a result, the free move of the return spring member is checked.

So as to avoid the above stated inconveniences, when the guide portion dimension of the collar member is set at least two times of the wire diameter of the return spring member, the return spring member can not slip out from the outer side portion of the guide portion of the collar member.

Besides, the space winding return spring member is constituted to combine two coil spring members, and each of two coil spring members has respectively the same diameter and the same wire diameter. However, when the torsional torque of the throttle valve shaft is changed according to demand, it is possible to install by changing the wire diameters of two coil spring members of the return spring member.

In the above stated case, the inner diameter of two coil spring members of the return spring member are made substantially same, and each of the wire diameter of two coil spring members can be fit substantially to the outer diameter of the collar member.

Accordingly, when the throttle valve is opened or closed, the torsional manner at both end portions of the return spring member is made substantially same, the run onto of two coil spring members of the return spring member can be restrained and the contact between the coil portions of the return spring member can be restrained.

Besides, even when the collar member is used, the thickness dimension (longitudinal direction) of the collar member in the direction of the throttle valve shaft becomes large, the contact portion between the collar member and the return spring member enlarges. As a result, since the portion where the return spring member contacts to the collar member moves together with the collar member, when the throttle valve is opened the force is added on the portion to where the inner diameter portion of the coil portion of the return spring member is contacted, thereby the hysteresis phenomenon occurs.

So as to prevent the above stated inconveniences, the smaller portion where both end portions of the return spring member are received by the collar member can give the less effects, if possible, the receiving portion is set with one winding number of turns. However, in such a case, since it increases the anxiety in which during the installing process the return spring member may incline, it is desirable to set the winding number of turns at the portion where the end portion of the return spring member is positioned on the collar member at least three winding number of turns or at least three times wire diameter of the coil spring member of the return spring member.

Besides, in the prior art technique, so as to compact the throttle valve actuator, the distance between the outer shape of the sleeve member and the inner diameter of the return spring member is made small as much as possible.

However, it has the danger in which the foreign matters such as the small stones and the sands may come into the sleeve member and the return spring member from the coil portion of the return spring member and the foreign matters can not get rid of during the operation of the throttle valve.

Consequently, the foreign matters are bitten, the stick phenomenon of the throttle valve occurs. Since the above stated inconveniences are caused the small interval between the sleeve member or the throttle valve shaft and the return spring member, it is necessary to provide the space where even the foreign matters come into the stick phenomenon does not occur.

Herein, during the running of the automobile, the small stones, for example, come into through the coil portion of the return spring member and these small stones have mostly the dimension of the diameter less than 3 mm, accordingly, when the interval is formed between the sleeve member or the throttle valve shaft and the return spring member at least 3 mm, even the foreign matters such as the small stones come into, the foreign matters can have idle condition in the coil portion of the return spring member.

As a result, in the case in which the space having the diameter corresponding to the diameter of the throttle valve shaft (in commonly, about 8–10 mm) is formed between the return spring member and the sleeve member and the throttle valve shaft, thereby the stick phenomenon can be got rid of completely.

Further, the washer member having the low friction coefficient may be provided between the collar member at the side of the throttle valve main body and the throttle valve main body, as a result, the collar member can be moved smoothly due to the end face of the washer member and the torque fluctuation in the thrust direction of the throttle valve shaft due to the return spring member can be reduced effectively.

Hereinafter, one embodiment of a throttle valve actuating apparatus for use in an internal combustion engine according to the present invention will be explained referring to from FIG. 1 to FIG. 5.

FIG. 1 is a longitudinal cross-sectional view showing one embodiment of a throttle valve actuating apparatus for use in an internal combustion engine according to the present invention.

In FIG. 1, a throttle valve actuating apparatus for use in an internal combustion engine of an automobile comprises mainly a throttle valve main body 1, a throttle valve 2, a throttle valve shaft 3, two collar members 7 and 8, a return spring member 9, and an acceleration drum member 11.

In the throttle valve main body 1, ball bearing members 5 are filled up, one end side face of the ball bearing member 5 is fixed through ball bearing pressing rings 6. In an inner diameter portion of the ball bearing member 5, the throttle valve shaft 3 is inserted and the throttle valve 2 is installed fixedly to this throttle valve shaft 3 through throttle valve stopping screw members 14. The throttle valve shaft 3 penetrates the throttle valve main body 1.

The return spring member 9 is retained on an axis of the throttle valve shaft 3, and further at an end portion of the throttle valve shaft 3 an acceleration drum member 11 to which acceleration wire (not shown) is connected is fixed through a spring washer member 12 and a nut 10.

On the axis of the throttle valve shaft 3, two collar members 7 and 8 are provided directly surrounding the return spring member 9 for the positioning members of the return spring member 9. Two collar members 7 comprise a first collar member 7 and a second collar member 8.

The first collar member 7 and the second collar member 8 are provided independently or separately on the throttle valve shaft 3, respectively. The first collar member 7 and the second collar member 8 have the same shape, and the second collar member 8 is arranged in opposition to the first collar member 7. The first collar member 7 is positioned at an outside of the throttle valve main body 1 and the second collar member 8 is positioned at an inside of the acceleration drum member 11.

Accordingly, these two collar members 7 and 8 can almost never turn the friction resistance on the throttle valve shaft 3. Each of the first and second collar members 7 and 8 is constituted by a cylindrical portion and a collar portion (guide portion), respectively.

Each width (length) of each of these two collar members 7 and 8 in the axial direction of the throttle valve shaft 3 has the dimension (size) on which three times winding turn of the return spring member 9 is ridden or positioned.

The space winding return spring member 9, as described in latter in detail, comprises by a combination of a first coil spring member 9A and a second coil spring member 9B. The first coil spring member 9A of the return spring member 9 has a spring hooking portion ***9a*1 and an inner diameter portion *9a*2. The second coil spring member 9B of the return spring member 9 has a spring hooking portion *9b*1 and an inner diameter portion *9b*2**.

The spring hooking portion ***9a*1 of the first coil spring member 9A is positioned on the second collar member 8 at an outermost left portion of the second collar member 8. The spring hooking portion *9b*1 of the second coil spring member 9B is positioned on the first collar member 7 at an outermost right portion of the first collar member 7**.

Figure 2:
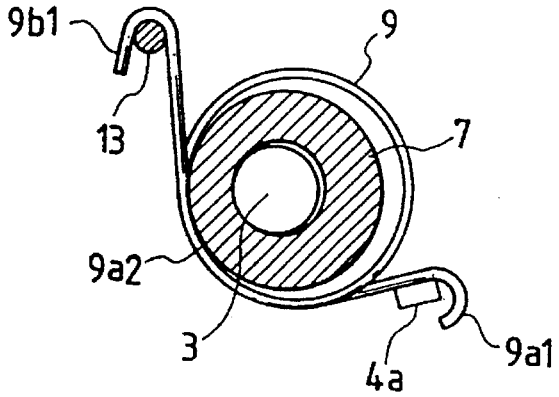
FIG. 2 is a cross-sectional view showing one embodiment of the throttle valve actuating apparatus taken from the radial direction of a throttle valve shaft according to the present invention.

This return spring member 9 is inserted on the throttle valve shaft 3. As shown in FIG. 2, at a projecting portion 13 provided in the throttle valve main body 1 the spring hooking portions 9*b*1 and 9*a*1 of the second and first coil spring members 9B and 9A are engaged and, another side spring hooking portions 9*a*1 and 9*b*1 of the first and second coil spring members 9A and 9B are engaged on a projecting portion 4*a* provided on a lever 4, respectively.

The lever 4 is constituted independently in this embodiment, however this lever can form integrally with the acceleration drum member 11. The return spring member 9 is retained around the throttle valve shaft 3 between the first collar member 7 and the second collar member 8 through the above stated engagement structure.

Figure 3:
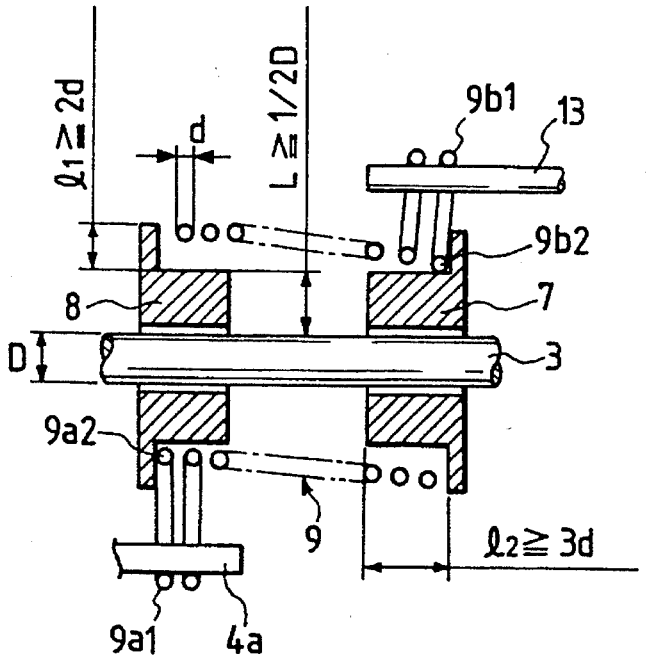
FIG. 3 is a cross-sectional view showing one embodiment of an installing condition of a return spring member according to the present invention.

As shown in FIG. 3, the right side coil portion of the return spring member 9 at the right end portion is fitted loosely with three times wire diameter of the return spring member 9 at the cylindrical portion of the first collar member 7, and the left coil portion of the return spring member 9 at the left end portion is fitted loosely with three times wire diameter of the return spring member 9 at the cylindrical portion of the second collar member 8, respectively.

Accordingly, the position arrangement structure of the return spring member 9 is defined around as a center of the throttle valve shaft 3.

When the acceleration drum member 11 is drawn by the acceleration wire member and the throttle valve shaft 3 is turned, the lever 4 fixed to the throttle valve shaft 3 is turned together. Then, the return spring member 9 is twisted and thereby the return torque generates.

In this time, as shown in FIG. 2, the inner diameter portion 9*a*2 of the first coil spring member 9A contacts necessarily to the cylindrical portion of the second collar member 8. Further, the inner diameter portion 9*b*2 of the second coil spring member 9B contacts necessarily to the cylindrical portion of the first collar member 7.

This causes by the fact in which when the return spring member 9 is installed into the throttle valve main body 1, and the return spring member 9 has given already an amount of torsion.

As a result, both end portions of the return spring member 9 are twisted by the hooking portion 9*b*1 of the second coil spring member 9B and by the hooking portion 9*a*2 of the first coil spring member 9A. Then, the return spring member 9 can vary with an variance which corresponds to a clearance between the inner diameter dimensions of the first and second collar member 7 and 8 and the inner diameter dimension of the return spring member 9.

Consequently, the separate forces generate at both end portions of the return spring member 9 due to the above stated variance, these forces are pressed to the cylindrical portions of the first and second collar members 7 and 8, and this time the frictional force resistance generates at the first and second collar members 7 and 8.

Herein, since the first collar member 7 contacts to an end face of a part 1*a* of the throttle valve main body 1, when the first collar member 7 turns with the throttle valve shaft 3 together, the large frictional force acts on, it has the anxiety about the return torque generated by twisting of the return spring member 9 does not transmit to the throttle valve shaft 3.

However, according to this embodiment of the present invention, by the provision of the above stated two independent first and second collar members 7 and 8, the inner diameter of the return spring member 9 is positioned by the first and second collar members 7 and 8 and further since the first and second collar members 7 and 8 are inserted directly to the throttle valve shaft 3, the friction coefficient can made small fully between the first and second collar members 7 and 8 and the throttle valve shaft 3.

Accordingly, the first and second collar members 7 and 8 can turn easily with the throttle valve shaft 3 under the condition of almost never receiving of the frictional force.

Further, according to this embodiment of the present invention, when the throttle valve shaft 3 is turned, the first collar member 7 becomes substantially a standstill condition and the second collar member 8 can turn with the lever 4 together.

However, in this time, as shown in FIG. 2, since the inner diameter potion 9*a*1 of the first coil spring member A contacts to the face of the cylindrical portion of the second collar member 8 and the inner diameter portion 9*b*2 of the second coil spring member 9B contacts to the face of the cylindrical portion of the first collar member 7, at the contact portions it has anxiety to cause the generation of the friction resistance.

The portion in which the inner diameter portion 9*a*2 of the first coil spring member 9A contacts to the face of the cylindrical portion of the first collar member 7, at the projecting portion 13 provided on the throttle valve main body 1 since the hooking portion 9*b*1 of the second coil spring member 9B is engaged with, the return spring member 9 is twisted as a whole by turning of the throttle valve shaft 3, the turning at this right portion is very slightly and the first collar member 7 contacts to the end face of a part 1*a* of the throttle valve main body 1.

The relative move between the return spring member 9 and the first collar member 7 is very slightly, accordingly, the contact portion between the return spring member 9 and the first collar member 7 hardly move.

Besides, the portion in which the inner diameter portion 9*a*2 of the first coil spring member 9A contacts to the face of the cylindrical portion of the second collar member 8, at the projecting portion 4*a* provided on the lever 4 since the hooking portion 9*a*1 of the first coil spring member 9A is engaged with, the left end portion is turned together with the throttle valve shaft 3, further the second collar member 8 contacts to the lever 4. The second collar member 8 can turn together with the throttle valve shaft 3.

The relative move between the throttle valve shaft 3 and the second collar member 8 is very slightly, accordingly, the contact portion between the throttle valve shaft 3 and the second collar member 8 hardly move.

Consequently, according to this embodiment of the present invention, it can be limited to the friction resistance acted on the return torque due to the return spring member 9 is merely the friction resistance between only the first collar member 7 within two first and second collar members 7 and 8 and the throttle valve shaft 3. Accordingly, the smooth return torque having no hysteresis phenomenon can be obtained.

Besides, as stated above, the first and second collar members 7 and 8 are installed to the throttle valve shaft 3 and the return spring member 9. Since the hooking portions 9*a*1 and 9*b*1 of the first and second coil spring members 9A and 9B are held by hooking to the projecting portions 13 and 4*a*, the return spring member 9 is moved toward the directions of the projecting portions 13 and 4*a*, the inner diameter portions 9*a*2 and 9*b*2 of the first and second coil spring members 9A and 9B contact to the first and second collar members 7 and 8.

As a result, the first and second collar members 7 and contact one-sided hitting to the throttle valve shaft 3, at this one-sided hitting portion the return torque can be dispersed and in this time according to the transmission of the torque, it gives an uncomfortable feeling to the driver.

FIG. 3 is a cross-sectional view showing one embodiment of an installing condition of the return spring member 9 according to the present invention. In FIG. 3, the hooking portions 9*a*1 and 9*b*1 of the first and second spring members 9A and 9B are supported by the projecting portions 13 and 4*a*, respectively.

However, as shown in FIG. 3, since the hooking portions 9*a*1 and 9*b*1 of the first and second coil spring members 9A and 9B are supported the return spring member 9 is inclined necessarily. This is caused by a fact in which the return spring member 9 has no rigidity at the winding direction and the coil portions at both end portions of the return spring member 9 the rigidity becomes high.

As a result, when the return spring member 9 is twisted, at both end portions of the return spring member 9 the direction of the force of the hooking portions 9*a*1 of the first coil spring member 9A is the reversed direction with the direction of the force of the hooking portion 9*a*2 of the second coil spring member 9B. The force is divided by the turn spring member 9 and the first and second collar members 7 and 8.

According to the above stated embodiment of the present invention, so as to transmit accurately the variance or the displacement of the return spring member 9, the first and second collar members 7 and 8 work the relative move.

Further, according to the above stated embodiment of the present invention, between the return spring member 9 and the first and second collar members 7 and 8 the contact friction occurs, when the friction force is large and the force does not transmit and it causes the intermittent move. Dividing the force by the return spring member 9 and the first and second collar members 7 and 8, it is the effective valid by dividing into the parts of the force of both end portions.

In this embodiment of the present invention, the guide portion is provided on the first collar member 7 and the guide portion is provided on the second collar member 8, respectively.

Each size dimension $l_1$ of the guide portions of the first and second collar members 7 and 8 is set at $l_1 \leqq 2d$ (d: return spring wire diameter), accordingly the coil portion of the return spring member 9 does not drop up from the guide portions of the first and second collar members 7 and 8.

Next, both end portions of the return spring member 9 are supported by the first and second collar members 7 and 8 of the return spring member 9, when a whole coil portion is received, since it contacts necessarily at the inner diameter portions 9*a*2 and 9*b*2 of the first and second coil spring members 9A and 9B, it is preferable to set short as possible as the thickness (length) $l_2$ of the first and second collar members 7 and 8 at the axial direction of the throttle valve shaft 3.

Herein, it may differ from the structure or the installing space for the return spring member 9, in general the winding number of turns of the return spring member 9 is set to have a range of about 10–12. Within the above stated winding number turn range of the return spring member 9, it is preferable set the thickness (length) $l_2$ of the first and second collar members 7 and 8 at the axial direction of the throttle valve shaft 3 as $l_2 \geqq 3d$ (d: return spring wire diameter).

In the above stated relationship between the thickness (length) $l_2$ of the first and second collar members 7 and 8 and the wire diameter of the return spring member 9, the return spring member 9 can be received with the good condition, even when the torque lowering is caused by the contact, the fluctuation for feeling and the driver's uncomfortable feeling do not generate.

As a result, in this embodiment of the present invention, the space winding return spring member 9 is ridden on the cylindrical portions of the first and second collar members 7 and 8. In other words, each of the dimension size of the length of the cylindrical portions of the first and second collar members 7 and 8 is set to have within three times winding number turn of the return spring member 9.

Figure 5:
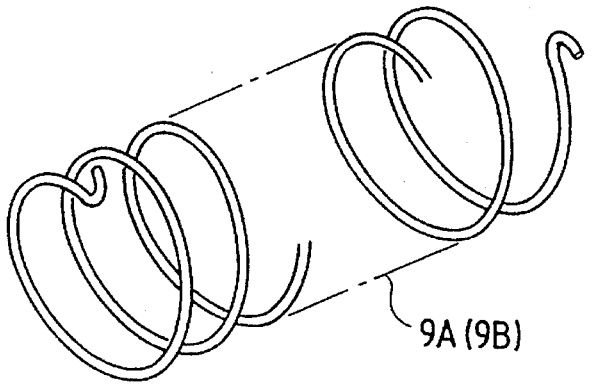
FIG. 5 is an explanatory view showing one embodiment of a single coil spring member construction for constituting the return spring member according to the present invention.

FIG. 5 is an explanatory view showing one embodiment of the first coil spring member 9A construction for constituting the return spring member 9 according to the present invention. The first coil spring member 9A is formed so as to have a space having constant value between two adjacent coil portions.

Further, the second coil spring member 9B is formed also so as to have a space having constant value between two adjacent coil portions. The second coil spring member 9B is formed similarly to have the same shape that of the first coil spring member 9A. Between two adjacent coil portions of the first coil spring member 9A, one coil portion of the second coil spring member 9B is arranged in the same line.

Figure 4:
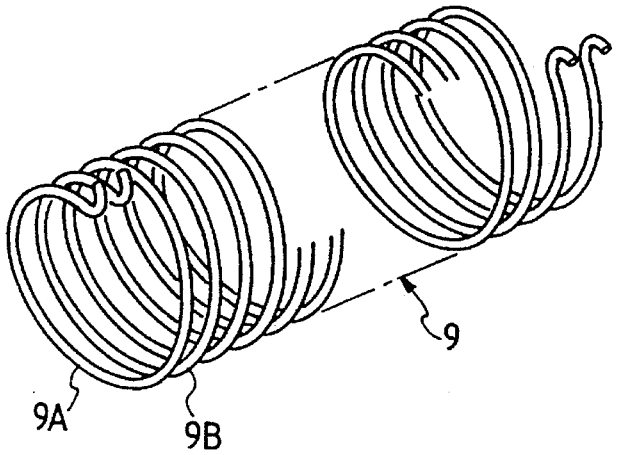
FIG. 4 is an explanatory view showing one embodiment of the detailed return spring member construction according to the present invention.

The construction about the return spring member 9 will be explained in detail referring to FIG. 4 and FIG. 5.

As stated above, in this embodiment of the present invention, the return spring member 9 comprise the first coil spring member 9A and the second coil spring member 9B. Namely, the return spring member 9 employs two parallel arrangement first and second coil spring members 9A and 9B in the same line.

As shown in FIG. 5, the return spring member 9 is formed the space winding having at least two times pitches. In other words, the return spring member 9 employs two coil spring members 9A and 9B in which the winding pitch is at least two times of the wire diameter of the spring wire and they have the substantially same winding diameter and substantially same winding number of turns.

As stated above, one coil portion of the second coil spring member 9B is arranged into between two adjacent coil portions of the first coil spring member 9A.

The return spring member 9 is comprised of a combined member in which the first coil spring member 9A is combined to position adjacently to the second coil spring member 9B, as this combined two parallel arrangement coil spring member construction is used as the return spring member 9.

Herein, for example, when the return spring member comprises two coil spring members and two coil spring members are formed to contact closely each other and are arranged successively at the same longitudinal line, thus the return spring member has no space at two adjacent coil portions.

In the above case, the size of the installing components on the throttle valve shaft made large and the length of the throttle valve shaft is made lengthily comparing with the space winding return spring member 9 defined in the present invention and it is necessary to provide a component such as a sleeve member, thus the component members are increased.

As a result, the dimension size projecting from the bearing portion of the throttle valve main body is made lengthily, it has the defect from an aspect of an antivibration strength.

However, according to the above embodiment of the present invention, since two parallel arrangement coil spring member construction is used as the space winding return spring member 9, the dimension size can be made small, and the installing characteristic is improved, the distance from the bearing portion can be made short, further the variance on the throttle valve shaft can be decreased with the vibration from the engine, the strong strength of the throttle valve shaft can be obtained fully.

Herein, it has not to need necessarily to form same wire diameter of the first coil spring member 9A and the wire diameter of the second coil spring member 9B, it can use the different wire diameter for them.

However, when the different wire diameters for the first coil spring member 9A and the second coil spring member 9B are employed, it is desirable to employ to have substantially same dimension inner diameters for the first coil spring member 9A and the second coil spring member 9B.

Next, another embodiment according to the present invention will be explained.

The basic concept of this embodiment of the present invention is realized in the embodiment shown in FIG. 1. Namely, in the construction shown in FIG. 1, since the first and second collar members 7 and 8 which retain the inner diameters the return spring member 9 are installed directly on the throttle valve shaft 3, it can prevent from increasing in the friction resistance due to the contact of the return spring member 9 with other components excluding the first and second collar members 7 and 8. Furthermore, there are several method for lowering the friction resistance.

First of all, so as to lower the friction resistance, there is a preparing method in which both first and second collar members 7 and 8 themselves are prepared by the material having the low friction coefficient, such as the nylon system synthetic resin material or the fluorine system synthetic resin material.

Next, there is a coating method in which the surfaces of both first and second collar members 7 and 8 they are coated by the material having the low friction coefficient, such as the nylon system synthetic resin material or the fluorine system synthetic resin material.

Further, there is a method for lowering the friction resistance between the throttle valve shaft 3 and the first and second collar members 7 and 8. For one example, so as to lower the friction resistance, it carries out to coat the chrome coating process to the surface of the throttle valve shaft 3 and the inner faces of the shaft bores of the first and second collar members 7 and 8, or it carries out to coat the fluorine system synthetic resin material coating process to the surface of the throttle valve shaft 3 and the inner faces of the shaft bores of the first and second collar members 7 and 8.

In the prior art technique, the surface processing for the throttle valve shaft is carried out a certain zinc coating processing, however according to the above embodiments of the present invention the friction resistance is decreased widely, the torque transmitting loss by the throttle valve shaft 3 and the hysteresis phenomenon due to the return torque by the return spring member 9 can be restrained fully, thereby the feeling given to the driver can be improved effectively.

Next, there is a reducing method for reducing the friction resistance in the return spring member 9 comprising of two coil spring members 9A and 9B.

As stated above, in this embodiment of the present invention, the first and second coil spring member 9A and 9B have the predetermined pitch, and between the coil portions the space is given, however even employing the above stated construction, it can not avoid the contact between the coil portions of the return spring member, as a result the friction resistance generates.

Thereby, as one embodiment, there is a coating method in which it carries out to coat the fluorine system synthetic resin material coating process to the surfaces of the first and second coil spring member 9A and 9B.

According to the above stated embodiment employing the coating method, since the generation of the friction resistance by the return spring member 9 can be restrained fully, the torque transmitting loss of the throttle valve shaft 3 can be decreased widely and also the hysteresis phenomenon of the throttle valve shaft 3 can be restrained fully.

Further, according to the above stated embodiment employing the coating method, since the return spring member 9 is coated by the fluorine system resin material, it has the merit in which it is unnecessary to provide the component for separating the return spring member 9, however in the prior art technique it is necessary to provide the above stated component.

Besides, during the running of the automobile, it is difficult to avoid the approach of the foreign matters such as the small stones or the sands into an engine room. Consequently, from the coil clearance of the return spring member 9 the foreign matters come into the foreign matters may adhere to the coil clearance by rains or the foreign matters adhere to the surface of the throttle valve shaft 3. Furthermore, by repeating the above stated adhesions, the foreign mattes are piled on the engine room.

In this time, in a case when the space between the inner diameter portion of the return spring member 9 and the surface of the throttle valve shaft 3 has the small space, it has the danger in which the friction force becomes to increase between the inner diameter portion of the return spring member 9 and the surface of the throttle valve shaft 3 according to the small stones or the sands, in the worst occasion, it has the danger that the stick phenomenon occurs.

Therefore, in this embodiment of the present invention, so as to prevent the above stated inconveniences, as shown in FIG. 3, the space having the dimension L is formed between the inner diameter portion of the return spring member 9 and the surface of the throttle valve shaft 3.

When the diameter of the throttle valve shaft 3 is set to have the dimension D, so as to form the space having the dimension L, it is constituted to satisfy the following relationship, namely $L \leqq D/2$.

In general, the diameter of the throttle valve shaft 3 is set about 8–12 mm, the space L has a range of 4–8 mm.

Next, another embodiment of a throttle valve actuating apparatus for use in an internal combustion engine according to the present invention will be explained referring to FIG. 6.

Figure 6:
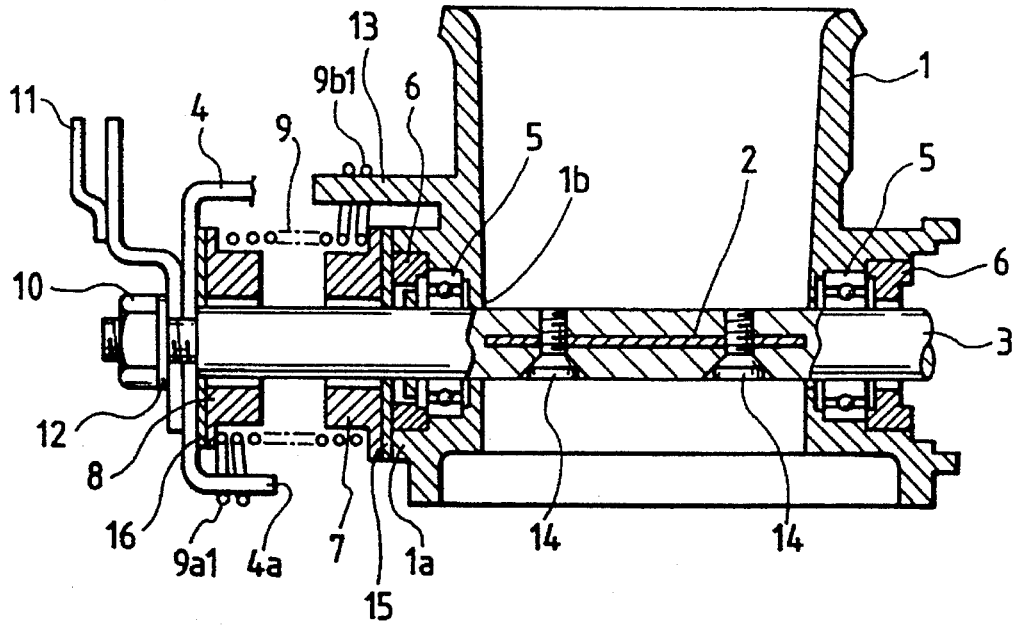
FIG. 6 is a longitudinal cross-sectional view showing another embodiment of a throttle valve actuating apparatus according to the present invention.

FIG. 6 is a longitudinal cross-sectional view showing another embodiment of a throttle valve actuating apparatus for use in an internal combustion engine according to the present invention.

Different constructions of this embodiment of the throttle valve actuating apparatus shown in FIG. 6 comparing with the throttle valve actuating apparatus structure shown in FIG. 1 are ones that a first washer member 15 is inserted between the first collar member 7 and the part 1*a* of the throttle valve main body 1 and a second washer member 16 is inserted between the second collar member 8 and the lever 4, respectively.

Each of these first and second washer members 15 and 16 is prepared by the material having the low friction coefficient such as nylon system synthetic resin material or fluorine system synthetic resin material.

Each of the surfaces of these first and second washer members 15 and 16 are coated by the material having the low friction coefficient such as the nylon system synthetic resin material or the fluorine system synthetic resin material.

Each of these prepared first and second washer members 15 and 16 works to reduce widely the frictional resistance between the first collar member 7 and a part 1*a* of the throttle valve main body 1 and also the frictional resistance between the second collar member 8 and the lever 4.

Consequently, according to this embodiment of the throttle valve actuating apparatus shown in FIG. 6, the torque transmitting loss of the return torque due to the return spring member 9 and the hysteresis phenomenon of the throttle valve shaft 3 can be restrained fully, thereby the feeling given to the driver can be improved remarkably.

Figure 7:
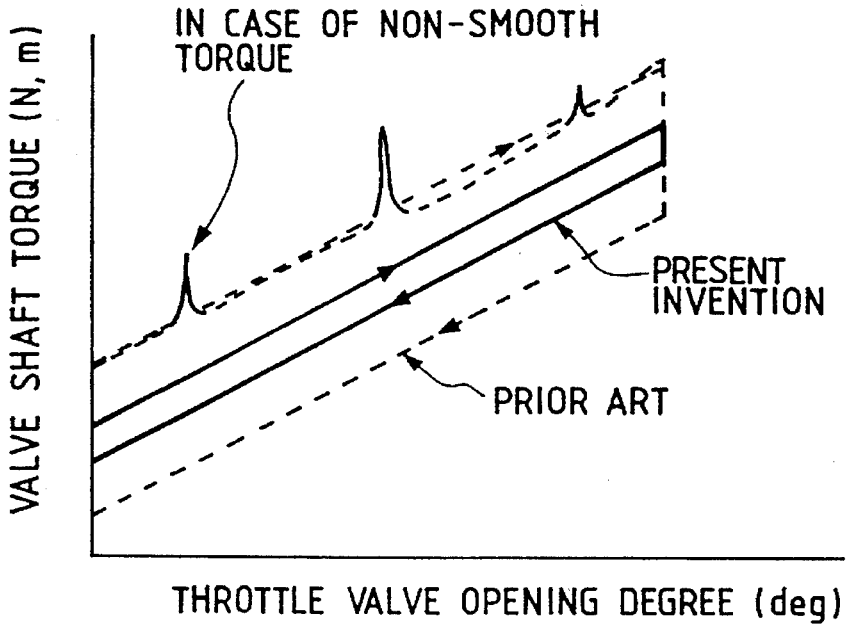
FIG. 7 is a characteristic diagram showing one embodiment of the torque characteristic according to the present invention compared with the torque characteristic according to the prior art.

FIG. 7 is the characteristic view showing one embodiment of the torque characteristic according to the present invention comparing to the torque characteristic according to the prior art.

The torque characteristic of the throttle valve shaft according to the prior art in FIG. 7 has the large hysteresis as a whole. There is the large difference in toque between in the case of increasing of the throttle valve opening degree and in the case of decreasing of the throttle valve opening degree.

Further, when the throttle valve opening degree is increased, in places the increase in torque having peak shape is accompanied with, consequently, the driver is aware of the touching and the extremely uncomfortable feeling is obtained.

Besides, as shown in the torque characteristic of the throttle valve shaft 3 according to the present invention in FIG. 7, the hysteresis phenomenon of the throttle valve shaft 3 remains slightly and further the change in torque of the throttle valve shaft 3 becomes smoothly as a whole, accordingly the superior feeling can be obtained.

I claim:

1. A throttle valve actuating apparatus for use in an internal combustion engine comprising:

a throttle valve main body;

bearing members provided on said throttle valve main body;

a throttle valve shaft penetrating said throttle valve main body and supported through said bearing members;

a throttle valve mounted fixedly on said throttle valve shaft in said throttle valve main body;

an acceleration drum member provided on one end portion of said throttle valve shaft; and a return spring member arranged between one side face of said throttle valve main body and said acceleration drum member;

said return spring member comprises:

a first coil spring member and a second coil spring member;

each of said first coil spring member and said second coil spring member having the substantially same inner diameter and the substantially same winding number of turns; and one coil portion of said second coil spring member arranged between two adjacent coil portions of said first coil spring member on the substantially same longitudinal line;

said return spring member giving always the return torque to said throttle valve; wherein the distance between two adjacent coil portions of said first coil spring member of said return spring member is at least the sum of the wire diameter of said first coil spring member and the wire diameter of said second coil spring member;

the distance between two adjacent coil portions of said second coil spring member of said return spring member is at least the sum of the wire diameter of said first coil spring member and the wire diameter of said second coil spring member; and a collar member comprises a first collar member and a second member;

said first collar member arranged at an outside of said one side face of said throttle valve main body and surrounding directly an outer peripheral portion of said throttle valve shaft;

said second collar member arranged at an inside of said acceleration drum member and surrounding directly said outer peripheral portion of said throttle valve shaft; and said first collar member and said second collar member retaining said return spring member therebetween thereby said return spring member is turned with said throttle valve shaft according to the relative movement of said first collar member and said second collar member and said return spring member is positioned according to said first collar member and said second collar member.

2. A throttle valve actuating apparatus for use in an internal combustion engine according to claim 1, wherein said first collar member has a guide member;

said second collar member has a guide member; and the length of said first collar member is at least two times the wire diameter of said return spring member; and the length of said second collar member is at least two times the wire diameter of said return spring member.

3. A throttle valve actuating apparatus for use in an internal combustion engine according to claim 1, wherein the diameter of said first collar member is set at least two times of the diameter of said throttle valve shaft; and the diameter of said second collar member is set at least two times of the diameter of said throttle valve shaft.

4. A throttle valve actuating apparatus for use in an internal combustion engine according to claim 1, wherein said first collar member is formed using a synthetic material having a low friction coefficient; and said second collar member is formed using a synthetic material having a low friction coefficient.

5. A throttle valve actuating apparatus for use in an internal combustion engine according to claim 1, wherein the surface of said throttle valve shaft is coated through a coating processing using a material having a low friction coefficient.

6. A throttle valve actuating apparatus for use in an internal combustion engine according to claim 1, wherein the length of said first collar member is at least three times the wire diameter of the coil portion of said return spring member; and the length of said second collar member is at least three times the wire diameter of the coil portion of said return spring member.

7. A throttle valve actuating apparatus for use in an internal combustion engine according to claim 1, wherein the wire diameter of said first coil spring member is substantial the same as the wire diameter of said second coil spring member.

8. A throttle valve actuating apparatus for use in an internal combustion engine according to claim 1, wherein the wire diameter of said first coil spring member differs from the wire diameter of said second coil spring member.

9. A throttle valve actuating apparatus for use in an internal combustion engine according to claim 1, wherein at least one of said first and second collar members includes a washer member.

10. A throttle valve actuating apparatus for use in an internal combustion engine according to claim 9, wherein the surface of said washer member is formed using a material having a low friction coefficient.

11. A throttle valve actuating apparatus for use in an internal combustion engine comprising:

a throttle valve main body;

bearing members provided on said throttle valve main body;

a throttle valve shaft penetrating said throttle valve main body and supported through said bearing members;

a throttle valve mounted fixedly on said throttle valve shaft in said throttle valve main body;

an acceleration drum member provided on one end portion of said throttle valve shaft; and a return spring member arranged between one side face of said throttle valve main body and said acceleration drum member;

said return spring member comprises:

a first coil spring member and a second coil spring member;

each of said first coil spring member and said second coil spring member having the substantially same inner diameter and the substantially same winding number of turns; and one coil portion of said second coil spring member arranged between two adjacent coil portions of said first coil spring member on the substantially same longitudinal line;

said return spring member giving always the return torque to said throttle valve; wherein the distance between two adjacent coil portions of said first coil spring member of said return spring member is at least the sum of the wire diameter of said first coil spring member and the wire diameter of said second coil spring member;

the distance between two adjacent coil portions of said second coil spring member of said return spring member is at least the sum of the wire diameter of said first coil spring member and the wire diameter of said second coil spring member; and a collar member comprises a first collar member and a second collar member;

said first collar member arranged at an outside of said one side face of said throttle valve main body and surrounding directly an outer peripheral portion of said throttle valve shaft, and said first collar member having a cylindrical portion and a guide portion;

said second collar member arranged at an inside of said acceleration drum member and surrounding directly said outer peripheral portion of said throttle valve shaft, and said second collar member having a cylindrical portion and a guide portion;

said second collar member arranged in opposition to said first collar member; and said first collar member and said second collar member retaining said return spring member therebetween thereby said return spring member is turned with said throttle valve shaft according to the relative movement of said first collar member and said second collar member and said return spring member is positioned according to said first collar member and said second collar member.

12. A throttle valve actuating apparatus for use in an internal combustion engine according to claim 11, wherein said second collar member has the same shape as said first collar member.

13. A throttle valve actuating apparatus for use in an internal combustion engine according to claim 11, wherein the length of said first collar member is at least two times said wire diameter of said return spring member; and the length of said second collar member is at least two times said wire diameter of said return spring member.

14. A throttle valve actuating apparatus for use in an internal combustion engine according to claim 11, wherein the diameter of said first collar member is at least two times the diameter of said throttle valve shaft; and the diameter of said second collar member is at least two times the diameter of said throttle valve shaft.

15. A throttle valve actuating apparatus for use in an internal combustion engine according to claim 11, wherein said first collar member includes a washer member, and said second collar member includes a washer member, respectively.

* * * * *